US008296137B2

(12) United States Patent
Lee et al.

(10) Patent No.: US 8,296,137 B2
(45) Date of Patent: Oct. 23, 2012

(54) METHOD AND APPARATUS FOR CODING AND DECODING AMPLITUDE OF PARTIAL

(75) Inventors: Nam-suk Lee, Suwon-si (KR); Geon-hyoung Lee, Hwaseong-si (KR); Jae-one Oh, Yongin-si (KR); Chul-woo Lee, Suwon-si (KR); Jong-hoon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1247 days.

(21) Appl. No.: 11/952,547

(22) Filed: Dec. 7, 2007

(65) Prior Publication Data

US 2008/0255855 A1 Oct. 16, 2008

(30) Foreign Application Priority Data

Apr. 12, 2007 (KR) ..... 10-2007-0036175

(51) Int. Cl.
*G10L 19/00* (2006.01)

(52) U.S. Cl. ..... 704/230

(58) Field of Classification Search ..... 704/230
See application file for complete search history.

(56) References Cited

U.S. PATENT DOCUMENTS 7,599,840 B2 * 10/2009 Mehrotra et al. ..... 704/501
2007/0238415 A1 * 10/2007 Sinha et al. ..... 455/66.1

FOREIGN PATENT DOCUMENTS

KR 10-2004-0100592 A 12/2004
KR 10-2005-0058262 A 6/2005
KR 10-2006-0083202 A 7/2006
WO 88/01811 A1 3/1988
WO 98/45951 A1 10/1998

OTHER PUBLICATIONS

Brinker et al. "Parametric Coding for High Quality Audio", Audio Engineering Society Paper, presented at the 112th convention, May 2002.*

Moon et al. "A Multi-Channel Audio Compression Method with Virtual Source Location Information for MPEG-4 SAC" IEEE Transactions on Consumer Electronics, Nov. 2005 pp. 1253-1259, vol. 51, No. 4.

Communication dated May 9, 2012 issued by the European Patent Office in counterpart European Application No. 08723216.1.

Edler, Bernd, et al., "ASAC—Analysis/Synthesis Audio Codec for Very Low Bit Rates", Preprints of Papers Presented at the AES Convention. XP001062332, May 11, 1996, pp. 1-15.

Korten, Pim, et al., "High-Resolution Spherical Quantization of Sinusoidal Parameters", IEEE Transactions on Audio, Speech and Language Processing, IEEE Service Center, NY, NY. Mar. 1, 2007, vol. 15, No. 3, pp. 966-981.

* cited by examiner

*Primary Examiner* — Jakieda Jackson
(74) *Attorney, Agent, or Firm* — Sughrue Mion, PLLC

(57) ABSTRACT

Provided are a method and apparatus for coding and decoding an amplitude of partials, in which a step phenomenon can be prevented in the result of coding the amplitude of continuation partial partials in a parametric codec, thereby improving reproduced sound quality. The method of coding the amplitude of partials includes obtaining an inversely quantized amplitude of partials of a previous frame, determining a quantization level based on a function for the inversely quantized amplitude of the partials of the previous frame, and quantizing an amplitude of partials of a current frame based on the determined quantization level.

17 Claims, 10 Drawing Sheets

METHOD AND APPARATUS FOR CODING AND DECODING AMPLITUDE OF PARTIAL

CROSS-REFERENCE TO RELATED PATENT APPLICATION

This application claims priority from Korean Patent Application No. 10-2007-0036175, filed on Apr. 12, 2007 in the Korean Intellectual Property Office, the disclosure of which is incorporated herein in its entirety by reference.

BACKGROUND OF THE INVENTION

1. Field of the Invention

Methods and apparatuses consistent with the present invention relate to audio coding and decoding, and more particularly, to coding and decoding an amplitude of partials in a parametric codec.

2. Description of the Related Art

A parametric codec is a combination of parametric coding for parsing and parametrizing an audio signal and parametric decoding for reconstructing a parameter to an audio signal. FIG. 1 is a flowchart of a related art parametric coding method. Parameters for audio components in each domain are extracted by performing three types of analysis, i.e., performing transient analysis in operation 101, performing sinusoidal analysis in operation 102, and performing noise analysis in operation 103.

The transient analysis deals with a dynamic audio change. The sinusoidal analysis deals with a deterministic audio change. The noise analysis deals with a stochastic or non-deterministic audio change. The extracted parameters are formatted into a bitstream in operation 104.

In related art parametric coding, the sinusoidal analysis involves analyzing a sinusoid of an input audio signal in order to generate partials and tracking generated partials. The partials are divided into continuation partials and birth partials by the tracking. As illustrated in FIG. 2, the continuation partials are related to partials of a previous frame and the birth partials are newly generated irrespective of the partials of the previous frame.

Related art parametric coding has more continuation partials than birth partials. Thus, a reduction in the number of bits for expressing the continuation partials and an improvement in the sound quality of the continuation partials exert a large influence on the reduction in the total number of bits and improvement in overall audio quality.

Referring to FIG. 3, in related art parametric coding, amplitude coding of continuation partials is performed by obtaining a quantized value Q_P of the amplitude of partials of a previous frame using a log scale method in operation 301 and a quantized value Q_C of the amplitude of partials of the current frame using a log scale method in operation 302. Next, a difference between the quantized value Q_P and the quantized value Q_C, i.e., D=Q_C−Q_P, is obtained in operation 303 and the obtained difference D is formatted into a bitstream in operation 304, thereby reducing the number of bits of continuation partials after being coded.

However, during amplitude coding of continuation partials, if the amplitude of the continuation partials gradually increases or decreases, a gradual amplitude variation cannot be expressed and only a large amplitude variation can be expressed, resulting in a step phenomenon in an amplitude variation as illustrated in FIG. 4.

FIG. 4 is a graph showing a relationship between the amplitude of continuation partials before being coded with respect to preset amplitude granularities (amp_granularity) and an amplitude variation with respect to a change of 1 in the quantized value Q_C. In FIG. 4, a horizontal axis indicates the amplitude of continuation partials before being coded and a vertical axis indicates an amplitude variation when the quantized value Q_C changes by 1.

Referring to FIG. 4, for an amp_granularity of 0, a step phenomenon does not occur in an amplitude variation. However, as the amp_granularity increases, the step phenomenon occurs to a large extent in the amplitude variation, causing degradation in reproduced sound quality.

Moreover, in related art amplitude coding of continuation partials, a difference between a quantized value of the amplitude of partials of a previous frame, which is obtained using a log scale method, and a quantized value of the amplitude of partials of the current frame, which is also obtained using the log scale method, i.e., the difference D in FIG. 3, is formatted into a bitstream without considering a frequency domain, causing a failure in efficiently reducing the number of bits of continuation partials. Furthermore, a large number of bits are used for expressing an amplitude variation in a small-amplitude portion that is not perceivable by human ears, resulting in a failure to efficiently reduce the number of bits in coding an audio signal.

SUMMARY OF THE INVENTION

The present invention provides a method and apparatus for coding and decoding an amplitude of partials, in which the occurrence of a step phenomenon in an amplitude variation is prevented during coding of the amplitude of continuation partials in a parametric codec, thereby improving reproduced sound quality.

The present invention also provides a method and apparatus for coding and decoding an amplitude of partials, in which the number of bits for expressing the amplitude of continuation partials in a parametric codec can be reduced.

According to one aspect of the present invention, there is provided a method of coding an amplitude of partials, the method including obtaining an inversely quantized amplitude of partials of a previous frame; determining a quantization level based on a function for the inversely quantized amplitude of the partials of the previous frame; and quantizing an amplitude of partials of a current frame according to the determined quantization level.

According to one aspect of the present invention, there is provided an apparatus for coding an amplitude of partials, the apparatus including a storage unit storing an inversely quantized amplitude of partials of a previous frame; a quantization level determination unit determining a quantization level based on a function for the inversely quantized amplitude of the partials of the previous frame; and a quantization unit quantizing an amplitude of partials of a current frame according to the determined quantization level.

According to one aspect of the present invention, there is provided a method of decoding an amplitude of partials, the method including detecting a quantized value of partials of a current frame from a bitstream-deformatted signal; obtaining an inversely quantized amplitude of partials of a previous frame; determining a quantization level based on a function for the inversely quantized amplitude of the partials of the previous frame; and inversely quantizing the detected quantization value according to the determined quantization level.

According to another aspect of the present invention, there is provided an apparatus for decoding an amplitude of partials, the apparatus including a quantized value detection unit detecting a quantized value of partials of a current frame from a bitstream-deformatted signal; a storage unit storing an inversely quantized amplitude of partials of a previous frame; a quantization level detection unit detecting a quantization level based on a function for the inversely quantized amplitude of the partials of the previous frame; and an inverse quantization unit inversely quantizing the detected quantization value according to the determined quantization level.

BRIEF DESCRIPTION OF THE DRAWINGS

The above and other aspects of the present invention will become more apparent by describing in detail an exemplary embodiment thereof with reference to the attached drawings in which.

DETAILED DESCRIPTION OF EXEMPLARY EMBODIMENTS OF THE INVENTION

Figure 1:
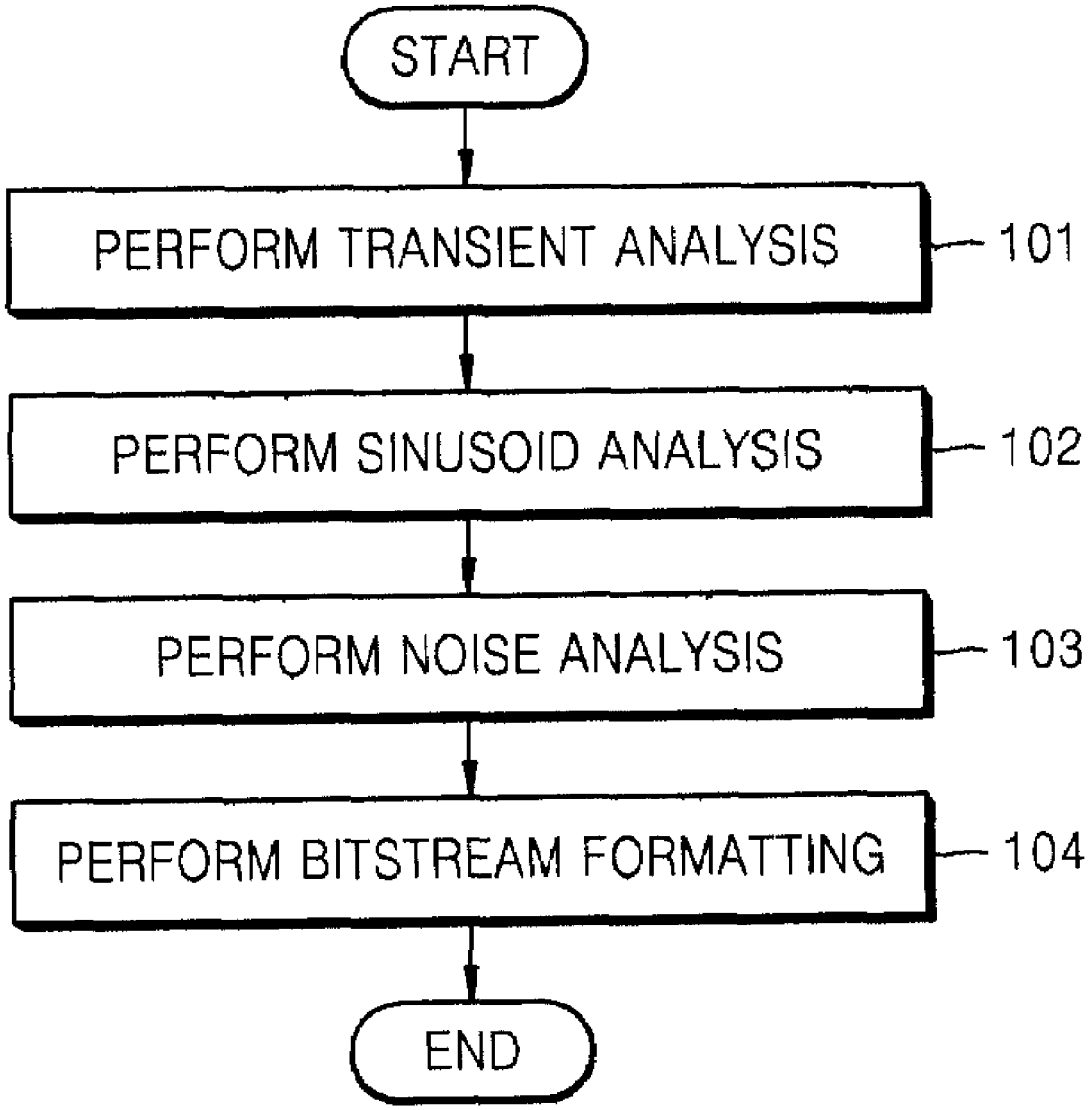
FIG. 1 (RELATED ART)
FIG. 1 is a flowchart of a related art parametric coding method.
Figure 2:
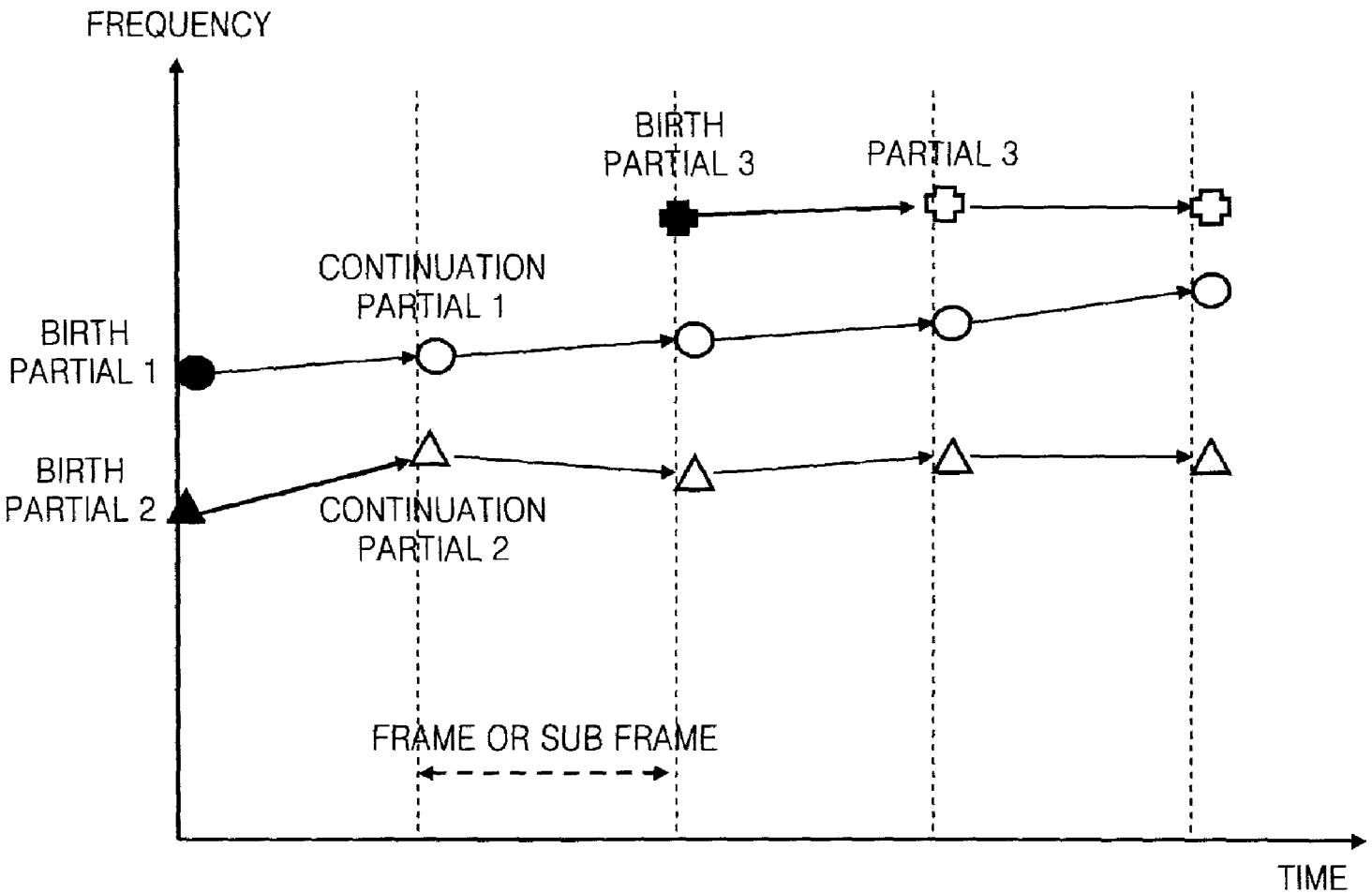
FIG. 2 (RELATED ART)
FIG. 2 is a view for explaining birth partial and continuation partial in related art parametric coding.
Figure 3:
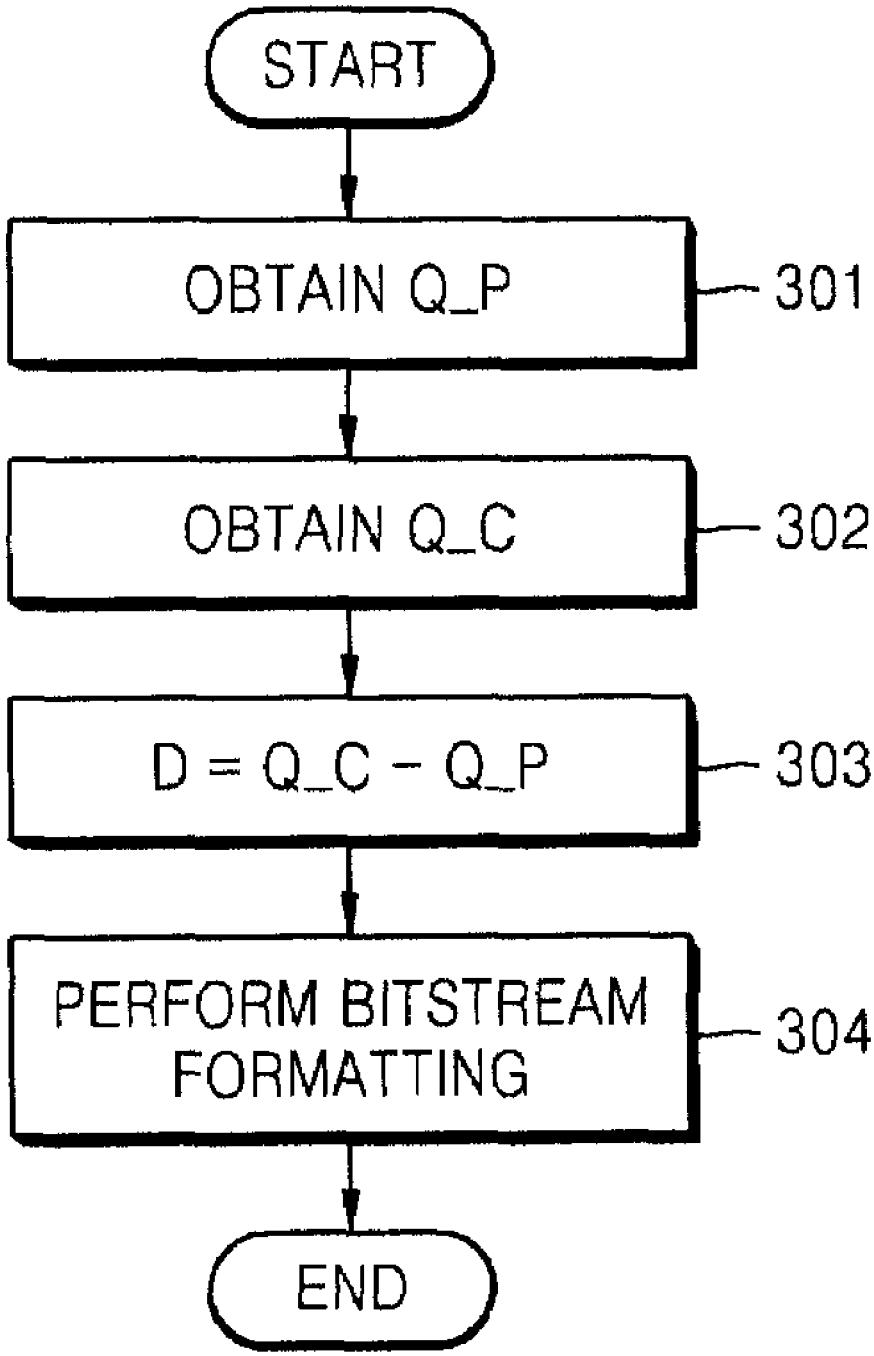
FIG. 3 (RELATED ART)
FIG. 3 is a flowchart of a method of coding the amplitude of continuation partials in related art parametric coding.

Hereinafter, exemplary embodiments of the present invention will be described in detail with reference to the accompanying drawings. It should be noted that like reference numerals refer to like elements illustrated in one or more of the drawings. In the following description of the present invention, detailed description of known functions and configurations incorporated herein will be omitted for conciseness and clarity.

The exemplary embodiments of the present invention determine a quantization level based on a function for an amplitude of partials of a previous frame and quantizes the amplitude of partials of the current frame based on the determined quantization level in order to prevent a step phenomenon from occurring in the result of coding with respect to the amplitude of continuation partial partials in a parametric codec. Moreover, the exemplary embodiments of the present invention adjust the function in order to change the quantization level according to frequency, thereby reducing the number of bits used for expressing the amplitude variation of the continuation partials. The exemplary embodiments of the present invention can also reduce the number of bits used for expressing the amplitude variation of a small-amplitude portion that is not perceivable by human ears.

Figure 5:
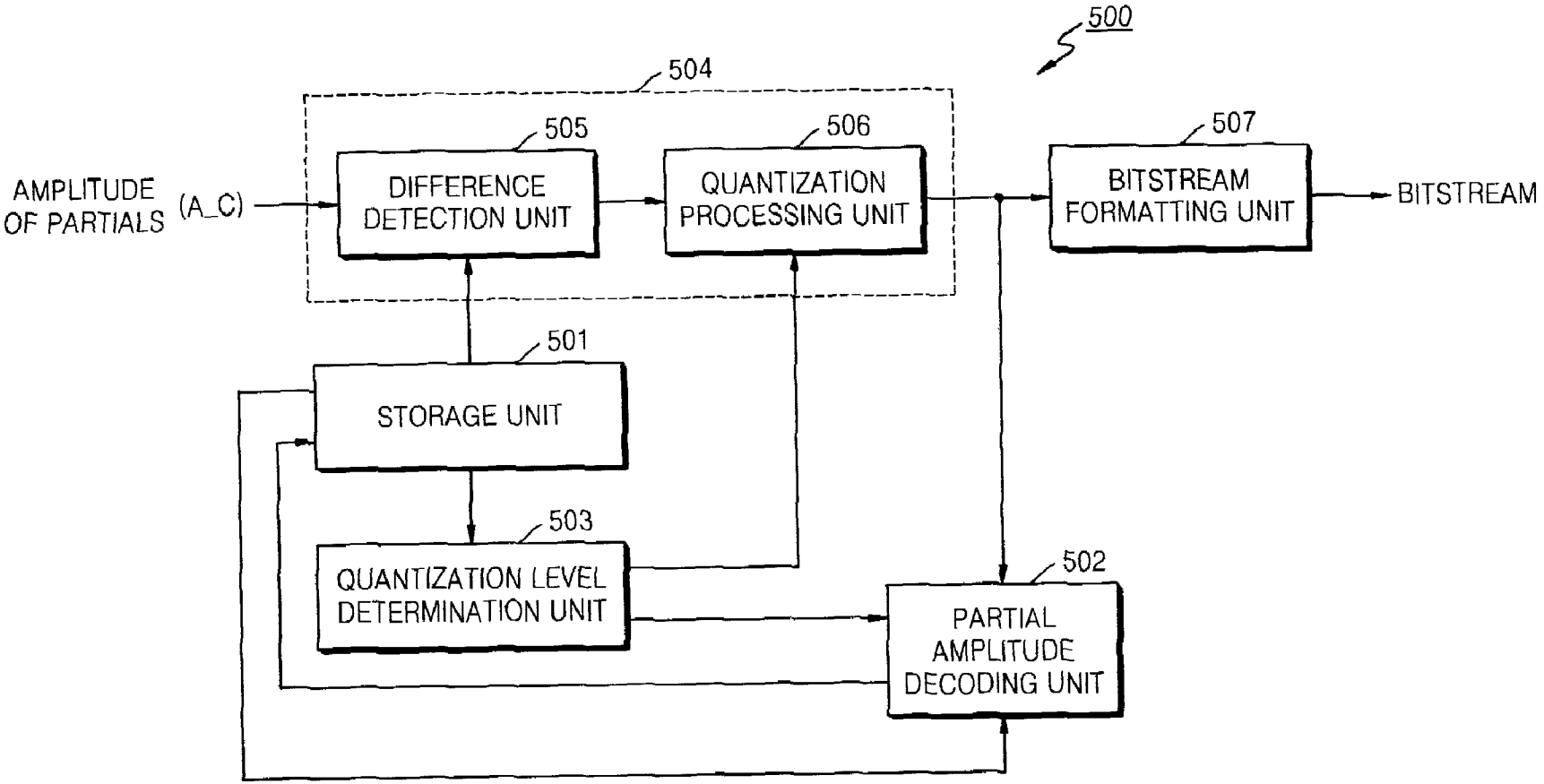
FIG. 5 is a block diagram of an apparatus for coding the amplitude of partials according to an exemplary embodiment of the present invention.

FIG. 5 is a block diagram of an apparatus 500 for coding the amplitude of partials according to the present invention. Referring to FIG. 5, the apparatus 500 includes a storage unit 501, a partial amplitude decoding unit 502, a quantization level determination unit 503, a quantization unit 504, and a bitstream formatting unit 507.

The storage unit 501 stores an inversely quantized amplitude (or a decoded amplitude) of the amplitude of partials of the current frame, which is provided from the partial amplitude decoding unit 502, and provides the stored inversely quantized amplitude as an inversely quantized amplitude prev_iq_amp (or a decoded amplitude) of the amplitude of partials of a previous frame, which hereinafter will be referred to as an inversely quantized amplitude for the partials of the previous frame, during quantization with respect to the amplitude of partials of a next frame.

Upon receipt of a quantized value D of partials of the current frame from the quantization unit 504, the partial amplitude decoding unit 502 inversely quantizes the received quantized value D in order to obtain an inversely quantized value. In other words, the partial amplitude decoding unit 502 obtains the inversely quantized value by multiplying the received quantized value D by a quantization level provided from the quantization level determination unit 503. The partial amplitude decoding unit 502 then reads the inversely quantized amplitude for the partials of the previous frame, which is stored in the storage unit 501, and stores the result of adding the read inversely quantized amplitude to the inversely quantized value in the storage unit 501 as a decoded amplitude for the amplitude of partials of the current frame.

The quantization level determination unit 503 determines a quantization level Q_Level based on a preset function f(prev_iq_amp) for the inversely quantized amplitude of partials of the previous frame, i.e., Q_Level=f(prev_iq_amp). The function f(prev_iq_amp) may be set as a fixed function irrespective of the frequency of the partials. For example, if the amplitude of the partials of the previous frame is x, the function may be set to $Q_Level=(x)^{(1/2)}$ irrespective of frequency in order to determine the quantization level.

Human ears easily recognize a change in the amplitude of partials in a low-frequency domain, but this is not the case in a high-frequency domain. Thus, the quantization level may be determined by setting the function differently for the low-frequency domain and the high-frequency domain. For example, if the amplitude of the partials of the previous frame is x, the function is set to $Q_Level=(x)^{(1/2)}$ in the low-frequency domain and to $Q_Level=(x)^{(3/5)}$ in the high-frequency domain in order to determine the quantization level.

Figure 6:
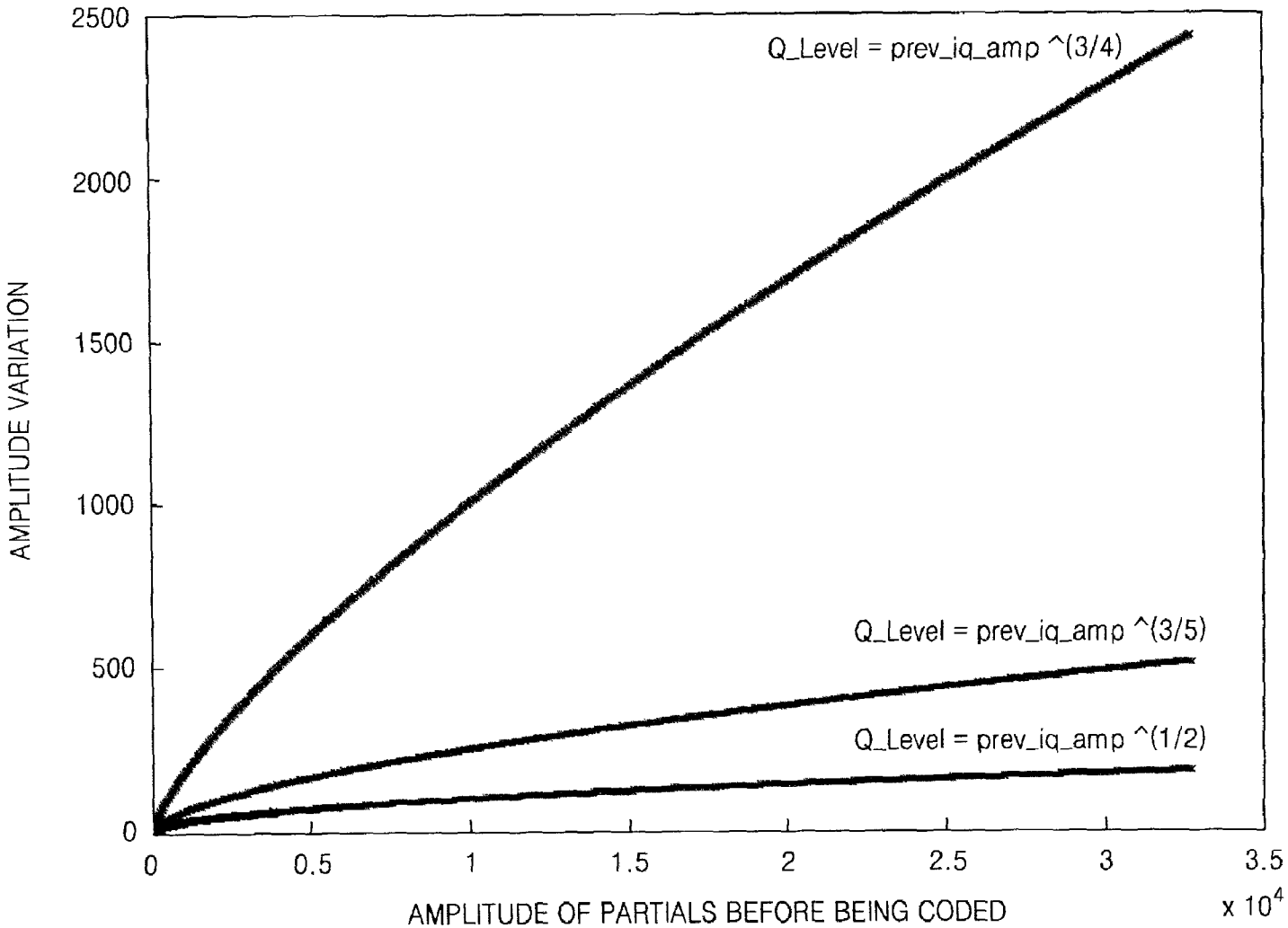
FIG. 6 is a graph showing a relationship between the amplitude of partials with respect to a preset function according to an exemplary embodiment of the present invention and an amplitude variation with respect to a change of 1 in a quantized value of the amplitude of partials of the current frame.

Alternatively, the function may be set differently for a low-frequency domain, an intermediate-frequency domain and a high-frequency domain. For example, as illustrated in FIG. 6, the quantization level is determined by setting the function to $Q_Level=(x)^{(1/2)}$ in the low-frequency domain, by setting the function to $Q_Level=(x)^{(3/5)}$ in the intermediate-frequency domain, and by setting the function to $Q_Level=(x)^{(3/4)}$ in the high-frequency domain. FIG. 6 is a graph showing a relationship between the amplitude of partials before being coded with respect to a function used for determining a quantization level according to the frequency of the partials and an amplitude variation with respect to a change of 1 in a quantized value of the amplitude of partials of the current frame. As can be seen from FIG. 6, a step phenomenon does not occur in an amplitude variation. This is because the amplitude of partials of the current frame is quantized using a quantization level that is set adaptively to an inversely quantized amplitude of partials of a previous frame. The quantization level determination unit 503 may determine the quantization level by setting the function in such a way that a quantization error in a high-frequency domain becomes larger than a quantization error in a low-frequency domain.

The quantization unit 504 quantizes the amplitude of partials of the current frame based on the quantization level determined by the quantization level determination unit 503. To this end, the quantization unit 504 includes a difference detection unit 505 and a quantization processing unit 506.

The difference detection unit 505 detects a difference Diff=A_C−prev_iq_amp between the amplitude A_C of partials of the current frame and an inversely quantized amplitude prev_iq_amp of partials of the previous frame. To this end, upon receipt of the amplitude A_C, the difference detection unit 505 reads the inversely quantized amplitude prev_iq_amp stored in the storage unit 501 and detects the difference between the amplitude A_C and the read inversely quantized amplitude prev_iq_amp.

The quantization processing unit 506 quantizes the difference detected by the difference detection unit 505 based on the quantization level determined by the quantization level determination unit 503, thereby obtaining a quantized value D of the amplitude of partials of the current frame. In other words, the quantization processing unit 506 may quantize the amplitude A_C based on an operation Diff/Q_Level of dividing the difference by the determined quantization level. At this time, the quantized value D obtained by the quantization processing unit 506 may be defined as the coded amplitude of the partials of the current frame. The quantization processing unit 506 may apply the obtained quantized value D to one of a rounding function round(Diff/Q_Level), a ceiling function and a floor function. A signal output from the quantization processing unit 506 is transmitted to the bitstream formatting unit 507 and then to the partial amplitude decoding unit 502.

The bitstream formatting unit 507 performs bitstream formatting on the quantized value transmitted form the quantization unit 504 and transmits the resulting value to an apparatus for decoding the amplitude of partials of the current frame or an apparatus for decoding an audio signal.

Figure 4:
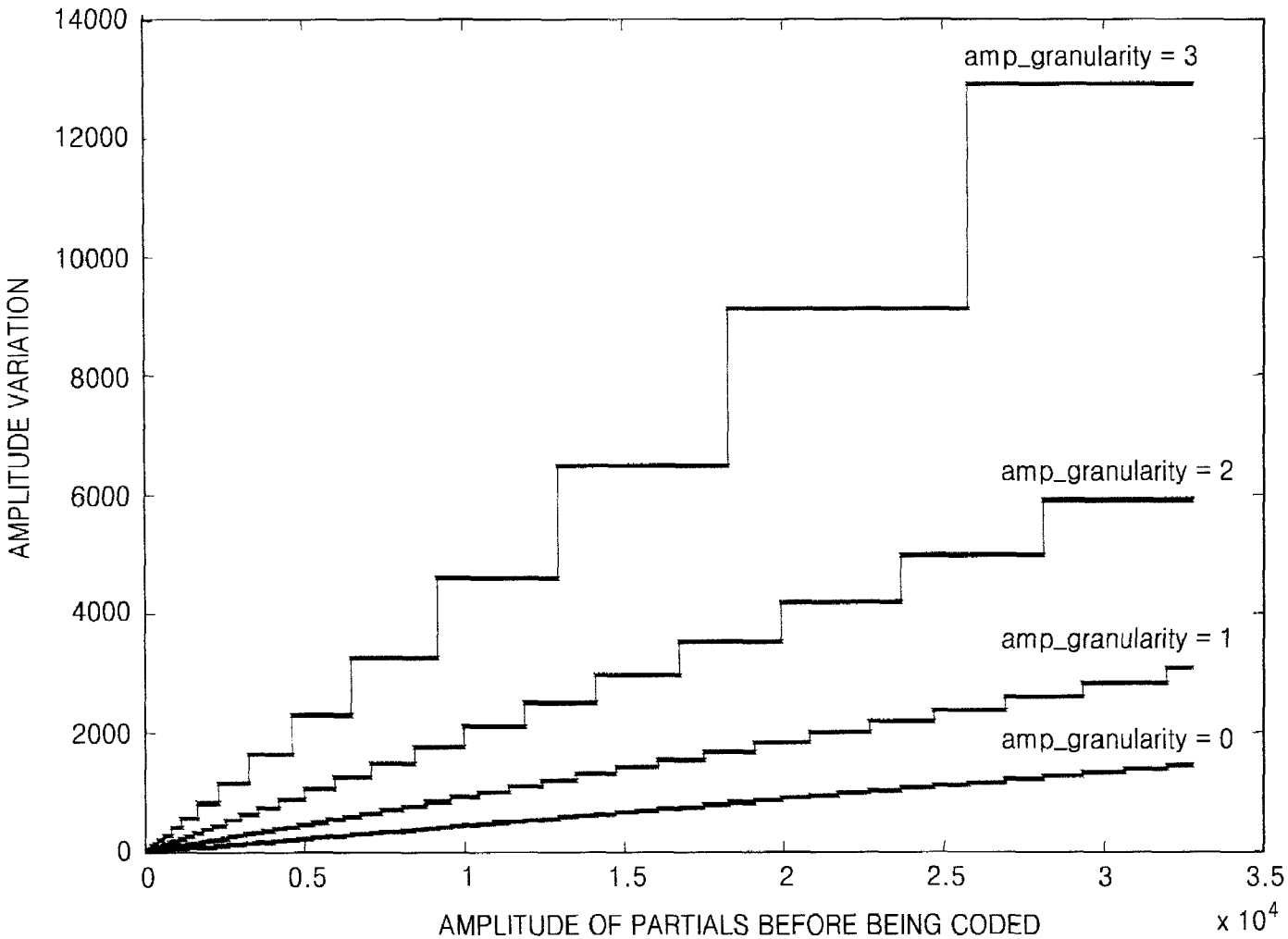
FIG. 4 (RELATED ART)
FIG. 4 is a graph showing a relationship between the amplitude of continuation partials before being coded with respect to preset amplitude granularities and an amplitude variation with respect to a change of 1 in a quantized value of the amplitude of partials of the current frame.
Figure 7:
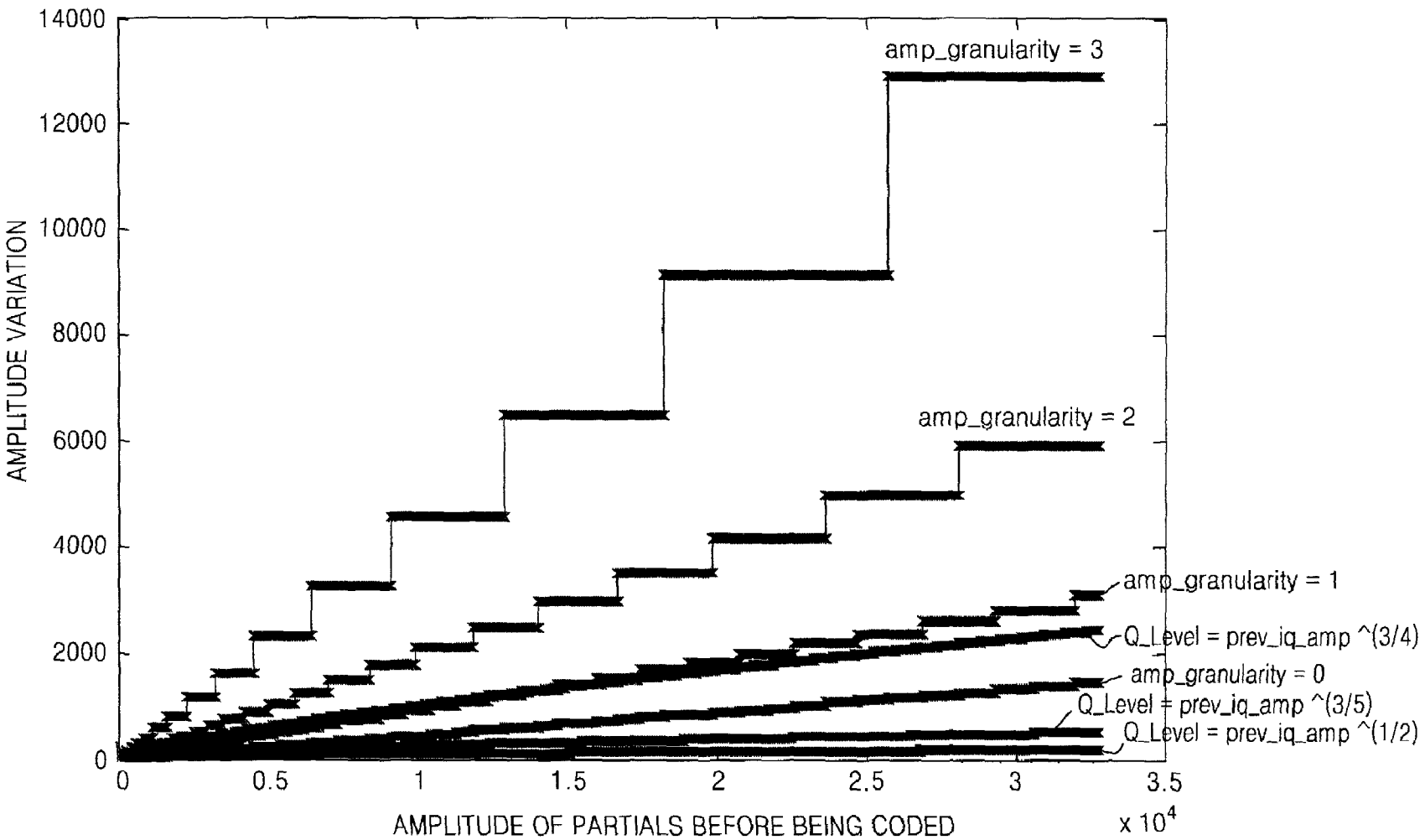
FIG. 7 is a graph for comparing the graph illustrated in FIG. 4 with the graph illustrated in FIG. 6.

FIG. 7 is a graph for comparing the graph illustrated in FIG. 4 with the graph illustrated in FIG. 6. Referring to FIG. 7, a step phenomenon occurs in an amplitude variation with respect to a change of 1 in a quantized value of the amplitude of partials as the amplitude of the partials gradually increases in conventional partial amplitude coding as can be seen in the graph based on FIG. 4, whereas a step phenomenon does not occur in an amplitude variation with respect to a change of 1 in a quantized value of the amplitude of partials as the amplitude of the partials gradually increases in partial amplitude coding according to the present invention as can be seen in the graph based on FIG. 6.

Referring to FIG. 4, in the graph based on FIG. 4, related art partial amplitude coding cannot follow a gradual increase in the amplitude variation of partials. Although related art partial amplitude coding can express a gradual increase in the amplitude variation of partials for an amplitude granularity amp_granularity of 0, a large amount of bits are required for expressing the gradual increase.

On the other hand, in the graph based on FIG. 6, partial amplitude coding according to the present invention can express a gradual increase in the amplitude variation of partials. A function for determining the quantization level can be set differently. For example, the function may be set to $(\text{prev_iq_amp})^{(1/2)}$, $(\text{prev_iq_amp})^{(3/5)}$, and $(\text{prev_iq_amp})^{(3/4)}$. By setting different quantization levels for different frequencies using a psychoacoustic method, the amount of bits can be reduced and sound quality degradation can also be prevented. For example, the function f(prev_iq_amp) for determining the quantization level is set to $(\text{prev_iq_amp})^{(1/2)}$ in a low-frequency domain, to $(\text{prev_iq_amp})^{(3/5)}$ in an intermediate-frequency domain, and to $(\text{prev_iq_amp})^{(3/4)}$ in a high-frequency domain.

Figure 8:
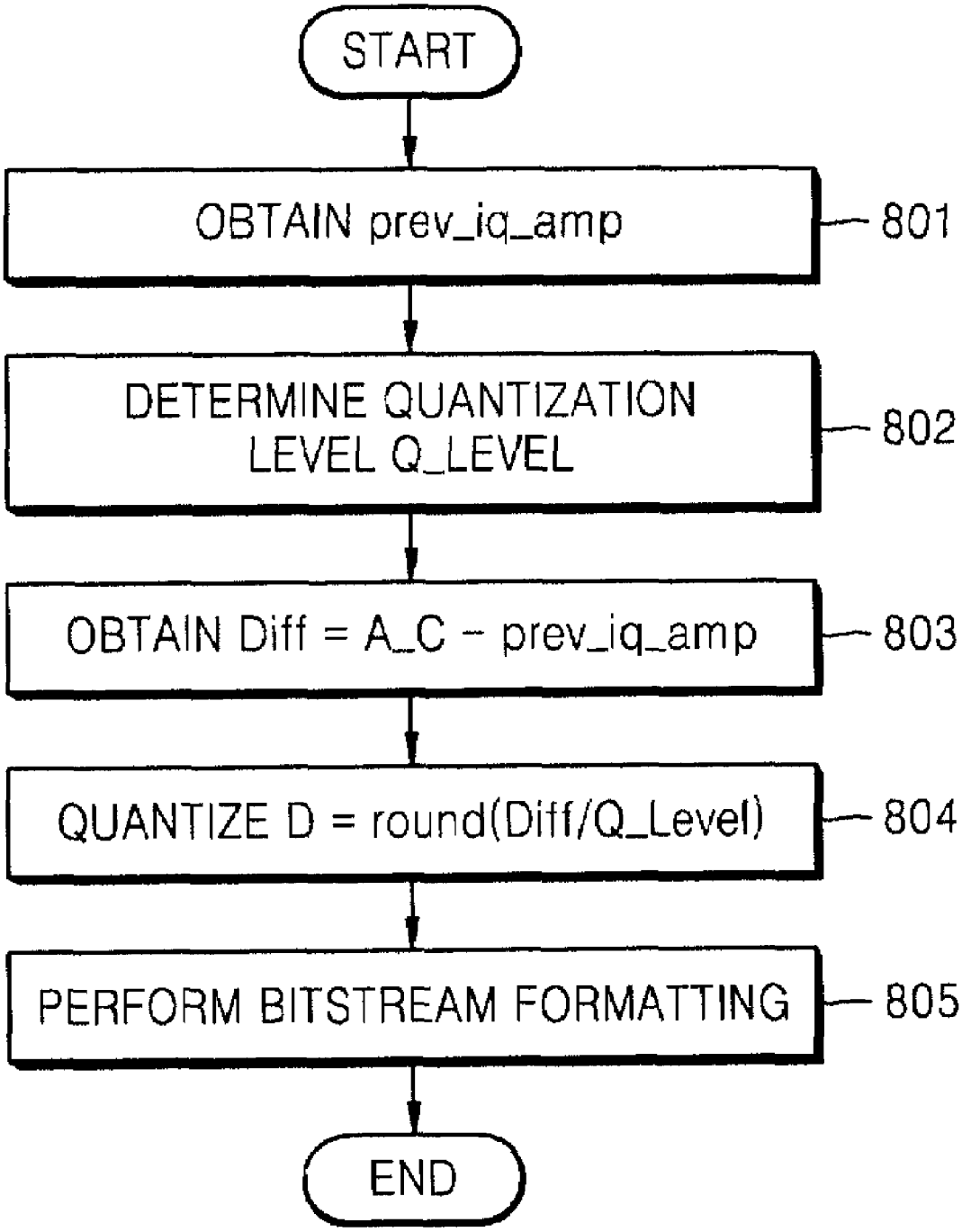
FIG. 8 is a flowchart of a method of coding the amplitude of partials according to an exemplary embodiment of the present invention.

FIG. 8 is a flowchart of a method of coding the amplitude of partials according to an exemplary embodiment of the present invention.

Referring to FIG. 8, an inversely quantized amplitude prev_iq_amp of partials of a previous frame is obtained in operation 801 in a similar manner to a manner in which the partial amplitude decoding unit 502 of FIG. 5 obtains an inversely quantized amplitude of partials of the current frame.

In operation 802, a quantization level Q_Level for quantizing the amplitude of partials of the current frame is determined using the inversely quantized amplitude prev_iq_amp. In other words, as already described regarding the quantization level determination unit 503 of FIG. 5, a preset function is applied to the inversely quantized amplitude prev_iq_amp obtained in operation 801, thereby determining the quantization level Q_Level. The function may be set as described with reference to FIG. 5.

In operation 803, a difference Diff=A_C−prev_iq_amp between the amplitude A_C of partials of the current frame and the inversely quantized amplitude prev_id_amp of the partials of the previous frame, which is obtained in operation 801, is obtained.

In operation 804, the difference Diff is quantized based on the quantization level Q_Level determined in operation 802. In other words, the difference Diff is quantized by applying a rounding function round(Diff/Q_Level) to the result of dividing the difference Diff by the quantization level Q_Level. However, the difference Diff may also be quantized by applying a ceiling function or a floor function to the result of the division. The quantized difference is a quantized value of the amplitude of the partials of the current frame. Thus, operation 803 and 804 may be defined as an operation of quantizing the amplitude of partials of the current frame based on the quantization level. In operation 805, the quantized value obtained in operation 801 is formatted into a bitstream.

Alternatively, operation 801 may be changed so that an inversely quantized amplitude of partials of the previous frame, which is stored in operation 801, is read in operation 801 and operation 805 may be changed so that bitstream formatting is performed and an inversely quantized amplitude of partials of the current frame is obtained and stored as described regarding the partial amplitude decoding 502 of FIG. 5. Thus, when the amplitude of partials of a next frame is coded, the stored inversely quantized amplitude of partials of the current frame may be read as an inversely quantized amplitude of partials of a previous frame.

In FIG. 8, the order of processing operation 802 and operation 803 are interchangeable.

Figure 9:
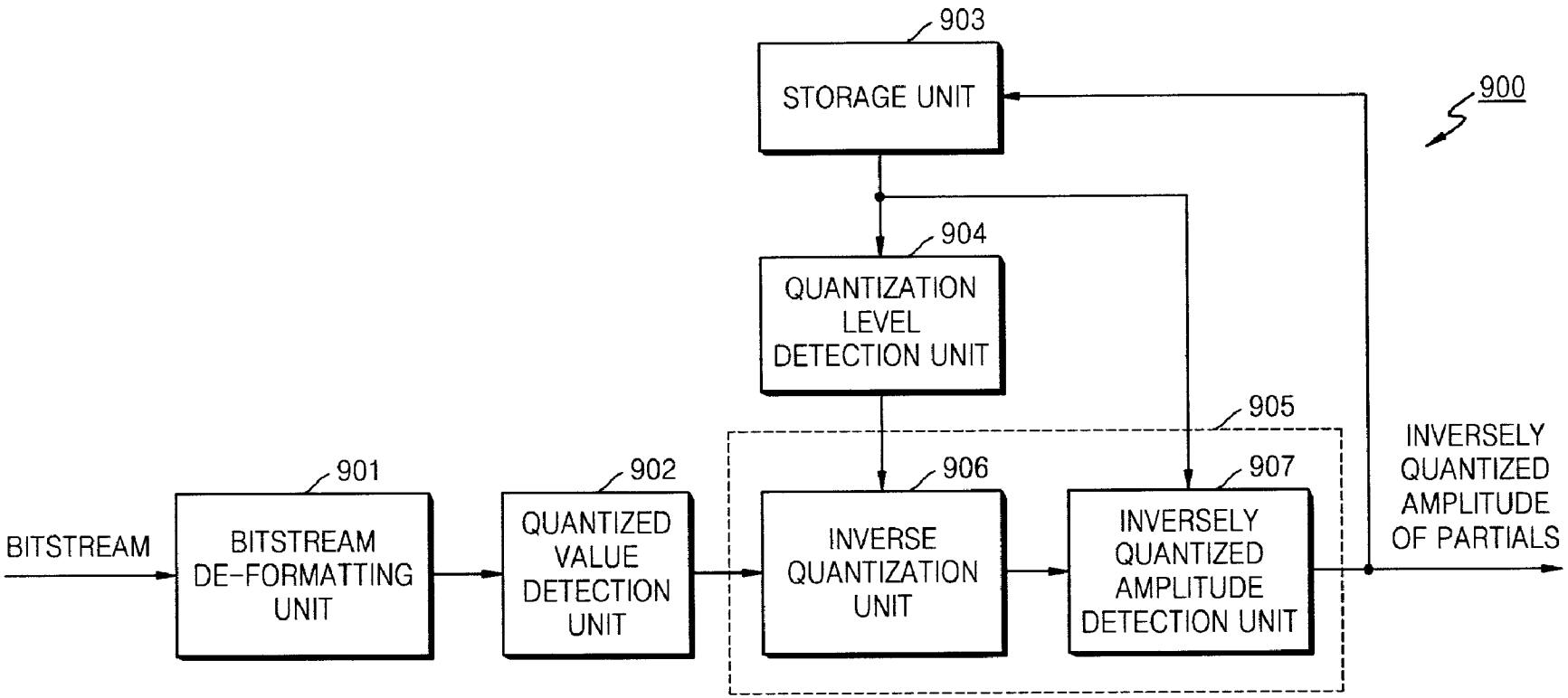
FIG. 9 is a block diagram of an apparatus for decoding the amplitude of partials according to an exemplary embodiment of the present invention.

FIG. 9 is a block diagram of an apparatus 900 for decoding the amplitude of partials according to an exemplary embodiment of the present invention. Referring to FIG. 9, the apparatus 900 includes a bitstream de-formatting unit 901, a quantized value detection unit 902, a storage unit 903, a quantization level detection unit 904, and an inverse quantization unit 905.

The bitstream de-formatting unit 901 de-formats a received bitstream.

Upon receipt of a bitstream de-formatted signal from the bitstream de-formatting unit 901, the quantized value detection unit 902 detects a quantized value of the amplitude of the partials of the current frame from the bitstream de-formatted signal. Such detection may be performed by, for example, detecting a quantized value from a preset field in the received bitstream de-formatted signal.

The storage unit 903 stores an inversely quantized amplitude of the partials of the current frame, which is output from the inverse quantization unit 905, and provides the stored inversely quantized amplitude as an inversely quantized amplitude of partials of the previous frame when inversely quantizing with respect to a quantized value of the amplitude of partials of a next frame.

The quantization level detection unit 904 detects a quantization level based on a function for the inversely quantized amplitude of partials of the previous frame, which is provided from the storage unit 903. The function is similar to that described regarding the apparatus 500 illustrated in FIG. 5 for coding the amplitude of partials according to the present invention.

The inverse quantization unit 905 inversely quantizes the quantized value detected by the quantized value detection unit 902 according to the quantization level detected by the quantization level detection unit 904. To this end, the inverse quantization unit 905 includes an inverse quantization block 906 and an inversely quantized amplitude detection unit 907.

The inverse quantization block 906 inversely quantizes the quantized value of the amplitude of the partials of the current frame based on the quantization level detected by the quantization level detection unit 904, thereby outputting an inversely quantized value of the amplitude of the partials of the current frame. The inversely quantized amplitude detection unit 907 detects an inversely quantized amplitude of the partials of the current frame based on the inversely quantized value output from the inverse quantization block 906 and the inversely quantized amplitude of the partials of the previous frame, which is read from the storage unit 903. In other words, the inversely quantized amplitude detection unit 907 outputs the result of adding the inversely quantized amplitude of the partials of the previous frame to the output inversely quantized value as the inversely quantized amplitude of the partials of the current frame. The output inversely quantized amplitude of the partials of the current frame is transmitted to the storage unit 903 and is also transmitted to a signal processing unit (not shown) for audio reproduction.

Figure 10:
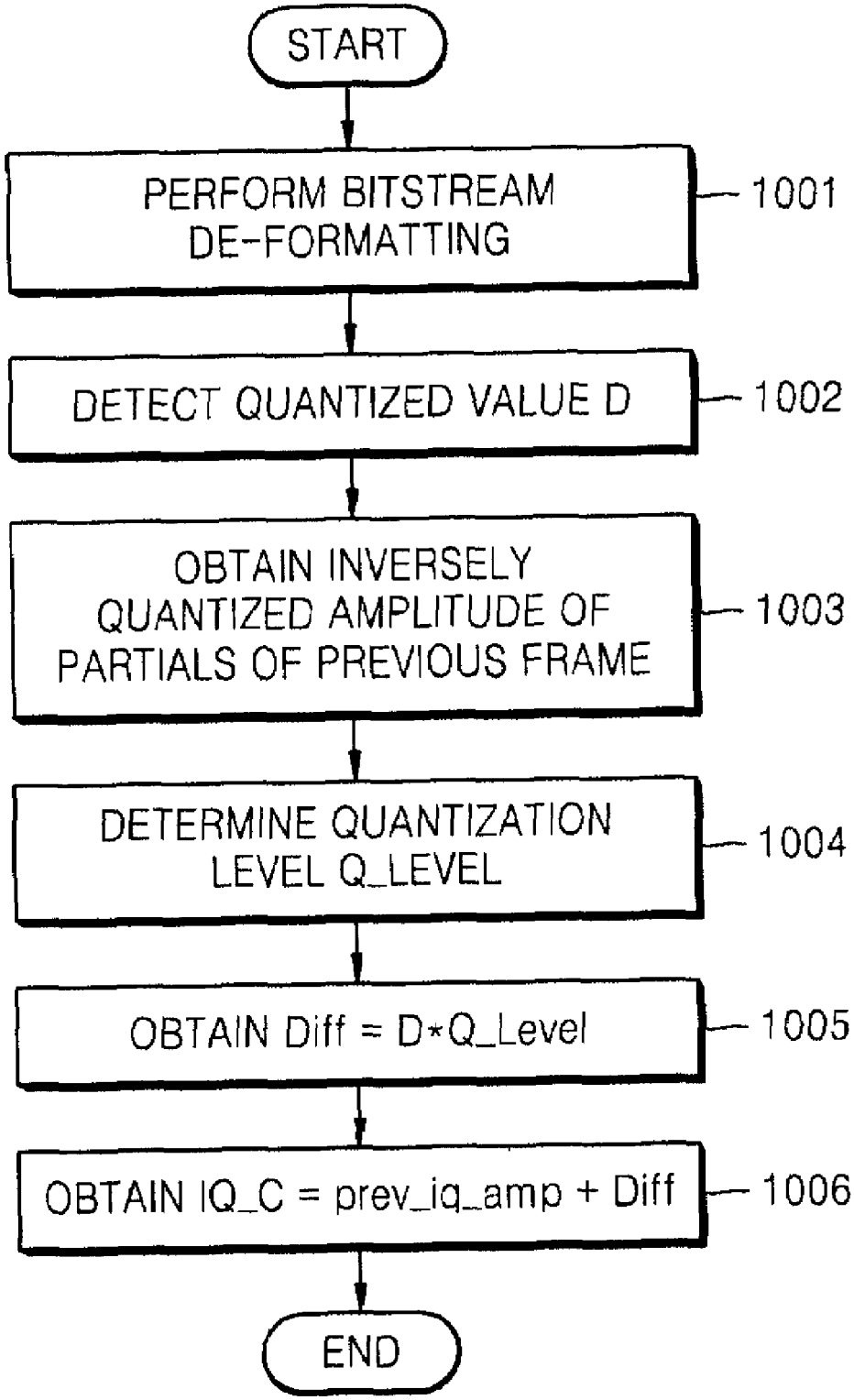
FIG. 10 is a flowchart of a method of decoding the amplitude of partials according to an exemplary embodiment of the present invention.

FIG. 10 is a flowchart of a method of decoding the amplitude of partials according to an exemplary embodiment of the present invention.

Referring to FIG. 10, a received bitstream is de-formatted in operation 1001. In operation 1002, a quantized value D of the amplitude of partials of the current frame is detected from a bitstream de-formatted signal. The detection is similar to that described with reference to FIG. 9.

In operation 1003, an inversely quantized amplitude prev_iq_amp of partials of a previous frame is obtained. The inversely quantized amplitude prev_iq_amp is obtained by adding an inversely quantized amplitude of a frame preceding the previous frame to an inversely quantized value of the amplitude of the partials of the previous frame.

In operation 1004, a quantization level Q_Level is determined based on a function for the inversely quantized amplitude prev_iq_amp. In other words, the quantization level Q_Level is determined by applying the preset function to the inversely quantized amplitude prev_iq_amp.

In operation 1005, an inversely quantized value Diff of the amplitude of partials of the current frame is obtained based on the quantized value D and the quantization level Q_Level determined in operation 1004. In other words, the inversely quantized value Diff is obtained by multiplying the quantized value D by the quantization level Q_Level.

In operation 1006, an inversely quantized amplitude IQ_C or cur_iq_amp of the partials of the current frame is obtained based on the inversely quantized value Diff and the inversely quantized amplitude prev_iq_amp. In other words, the result of adding the inversely quantized amplitude prev_iq_amp to the inversely quantized value Diff is obtained as the inversely quantized amplitude IQ_C.

The obtained inversely quantized amplitude IQ_C is processed in such a way as to reproduce an audio signal and can be stored in order to be used as an inversely quantized amplitude of partials of a previous frame when a quantized value of partials of a next frame is inversely quantized. If the method in FIG. 10 includes an operation storing the inversely quantized amplitude IQ_C obtained in operation 1006, operation 1003 can be defined as operation reading the stored inversely quantized amplitude of partials of the previous frame.

Thus, operations 1005 and 1006 of FIG. 10 may be defined as an operation of inversely quantizing the detected quantized value according to the quantization level.

As described above, according to the exemplary embodiments of the present invention, the amplitude of partials of the current frame is quantized using a quantization level determined based on a function for an inversely quantized amplitude of partials of a previous frame, thereby preventing a step phenomenon in an amplitude variation when coding with respect to the amplitude of continuation partial partials and improving reproduced sound quality.

Moreover, by determining a quantization level adaptively according to frequency, the number of bits for expressing the coded amplitude of continuation partial partials can be reduced. In particular, the number of bits for expressing the variation of a small-amplitude portion that is not perceivable by human ears in an amplitude of partials is reduced, thereby reducing the total number of bits in a parametric codec.

The method of coding and decoding the amplitude of partials according to the present invention can be embodied as code that is readable by a computer on a computer-readable recording medium. The computer-readable recording medium includes all kinds of recording devices storing data that is readable by a computer system. Examples of the computer-readable recording medium include read-only memory (ROM), random access memory (RAM), CD-ROMs, magnetic tapes, floppy disks, and optical data storage devices. The computer readable recording medium can also be distributed over network coupled computer systems so that the computer readable code is stored and executed in a distributed fashion. Also, functional programs, code, and code segments for implementing the present invention can be easily construed by programmers of ordinary skill in the art.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of coding an amplitude of partials, the method comprising:

obtaining an inversely quantized amplitude of partials of a previous frame;

determining a quantization level based on a function for the inversely quantized amplitude of the partials of the previous frame, the function being varied according to the inversely quantized amplitude of the partials of the previous frame; and quantizing an amplitude of partials of a current frame based on the determined quantization level.

2. The method of claim 1, wherein the quantizing the amplitude of the partials of the current frame comprises:

obtaining a difference between the amplitude of the partials of the current frame and the inversely quantized amplitude of the partials of the previous frame; and quantizing the difference based on the determined quantization level, wherein a quantized value obtained by quantizing the difference is a quantized value of the amplitude of the partials of the current frame.

3. The method of claim 2, wherein the quantizing the difference is performed based on an operation of dividing the difference by the quantization level.

4. The method of claim 1, wherein the obtaining the inversely quantized amplitude comprises:

quantizing the partials of the previous frame;

inversely quantizing the obtained quantized value; and adding an inversely quantized amplitude of partials of a frame preceding the previous frame to an inversely quantized value obtained by the inverse quantization, thereby obtaining the inversely quantized amplitude of the partials of the previous frame.

5. The method of claim 4, wherein the function is set so that the quantization level changes with a frequency.

6. An apparatus for coding an amplitude of partials, the apparatus comprising:

a storage unit which stores an inversely quantized amplitude of partials of a previous frame;

a quantization level determination unit which determines a quantization level based on a function for the inversely quantized amplitude of the partials of the previous frame, the function being varied according to the inversely quantized amplitude of the partials of the previous frame; and a quantization unit which quantizes an amplitude of partials of a current frame based on the quantization level determined by the quantization level determination unit, wherein at least one of the storage unit, the quantization level determination unit and the quantization unit, is implemented as a hardware component.

7. The apparatus of claim 6, wherein the quantization unit comprises:

a difference detection unit which detects a difference between the amplitude of the partials of the current frame and the inversely quantized amplitude of the partials of the previous frame; and a quantization block which quantizes the difference based on the determined quantization level, wherein a quantized value obtained by the quantization block is a quantized value of the amplitude of the partials of the current frame.

8. The apparatus of claim 7, further comprising a partial amplitude decoding unit which decodes the quantized value of the partials of the current frame, which is output from the quantization unit, based on the quantization level.

9. The apparatus of claim 8, wherein the partial amplitude decoding unit inversely quantizes the quantized value and stores in the storage unit a result of adding the inversely quantized amplitude of the partials of the previous frame, which is read from the storage unit, to the inversely quantized value obtained by the inverse quantization.

10. The apparatus of claim 8, wherein the function is set so that the quantization level changes with a frequency.

11. The apparatus of claim 8, wherein the quantization unit quantizes the difference based on an operation of dividing the difference between the amplitude of the partials of the current frame and the inversely quantized amplitude of the partials of the previous frame by the quantization level by the quantization level.

12. A method of decoding an amplitude of partials, the method comprising:

detecting a quantized value of partials of a current frame from a bitstream-deformatted signal;

obtaining an inversely quantized amplitude of partials of a previous frame;

determining a quantization level based on a function for the inversely quantized amplitude of the partials of the previous frame, the function being varied according to the inversely quantized amplitude of the partials of the previous frame; and inversely quantizing the detected quantization value based on the determined quantization level.

13. The method of claim 12, wherein the inversely quantizing the detected quantization value comprises:

obtaining an inversely quantized value of the partials of the current frame based on the quantized value and the quantization level; and obtaining an inversely quantized amplitude of the partials of the current frame based on the inversely quantized value and the inversely quantized amplitude of the partials of the previous frame.

14. The method of claim 13, wherein the obtaining the inversely quantized amplitude of the partials of the previous frame comprises:

inversely quantizing a quantized value of the partials of the previous frame; and adding an inversely quantized amplitude of partials of a frame preceding the previous frame to the inversely quantized value obtained by the inverse quantization, thereby obtaining the inversely quantized amplitude of the partials of the previous frame.

15. The method of claim 12, wherein the obtaining the inversely quantized amplitude of the partials of the previous frame comprises:

inversely quantizing a quantized value of the partials of the previous frame; and adding an inversely quantized amplitude of partials of a frame preceding the previous frame to the inversely quantized value obtained by the inverse quantization, thereby obtaining the inversely quantized amplitude of the partials of the previous frame.

16. An apparatus for decoding an amplitude of partials, the apparatus comprising:

a quantized value detection unit which detects a quantized value of partials of a current frame from a bitstream-deformatted signal;

a storage unit which stores an inversely quantized amplitude of partials of a previous frame;

a quantization level detection unit which detects a quantization level based on a function for the inversely quantized amplitude of the partials of the previous frame, the function being varied according to the inversely quantized amplitude of the partials of the previous frame; and an inverse quantization unit which inversely quantizes the quantization value detected by the quantization value detection unit based on the quantization level detected by the quantization level detection unit, wherein at least one of the quantized value detection unit, the storage unit, the quantization level detection unit and the inverse quantization unit, is implemented as a hardware component.

17. The apparatus of claim 16, wherein the inverse quantization unit comprises:

an inverse quantization block which inversely quantizes the quantized value detected by the quantization value detection unit based on the quantization level; and an inversely quantized amplitude detection unit which detects an inversely quantized amplitude of the partials of the current frame based on the inversely quantized value and the inversely quantized amplitude of the partials of the previous frame, wherein the inversely quantized amplitude of the partials of the current frame, which is detected by the inversely quantized amplitude detection unit, is stored in the storage unit.

* * * * *